US006839912B2

(12) United States Patent
Lewis

(10) Patent No.: US 6,839,912 B2
(45) Date of Patent: Jan. 11, 2005

(54) PROTECTIVE GLOVE HAVING INNER RIBS BETWEEN INNER LINER AND OUTER SHELL

(75) Inventor: Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 161 days.

(21) Appl. No.: 10/161,562

(22) Filed: Jun. 3, 2002

(65) Prior Publication Data

US 2003/0221235 A1 Dec. 4, 2003

(51) Int. Cl.[7] ..... A41D 19/00
(52) U.S. Cl. ..... 2/161.6
(58) Field of Search ..... 2/16.2, 161.6, 2/161.1–161.4

(56) References Cited

U.S. PATENT DOCUMENTS 2,552,258 A * 5/1951 Collins ..... 2/169
2,849,786 A * 9/1958 Ashley et al. ..... 2/159
3,217,333 A * 11/1965 Sweet et al. ..... 2/18
3,548,413 A * 12/1970 Jackson ..... 2/16
4,104,740 A * 8/1978 Rinehart ..... 2/158
4,302,851 A * 12/1981 Adair ..... 2/158
4,433,439 A 2/1984 Sidman et al.
4,454,611 A * 6/1984 Tschirch et al. ..... 2/8
4,918,756 A 4/1990 Grilliot et al.
5,349,705 A 9/1994 Ragan
5,369,806 A 12/1994 Chan
5,641,316 A * 6/1997 Bakalis ..... 441/57
5,822,796 A 10/1998 Harges, Jr. et al.
6,571,397 B1 * 6/2003 Williams ..... 2/239

* cited by examiner

*Primary Examiner*—Katherine Moran
(74) *Attorney, Agent, or Firm*—Wood, Phillips, Katz ,Clark & Mortimer

(57) ABSTRACT

In a protective glove having a wristlet and having a back face adapted to cover a back face of a wearer's hand, the back face has a thumb-covering portion and four finger-covering portions, which include an index finger-covering portion adjacent to the thumb-covering portion, and the back face has an inner liner and an outer shell, wherein the outer shell of the back face is folded and is sewn where folded so as to define inner ribs, which point toward and are able to touch the inner liner and which when touching the inner liner define pockets containing air providing thermal insulation. In one contemplated embodiment, the ribs include a rib terminating approximately where the thumb-covering portion and the index finger-covering portion meet and three other ribs, each terminating approximately where two of the finger-covering portions meet. In an alternative embodiment, in which the ribs extend across the protective glove, the ribs include ribs extending across the finger-covering portions.

7 Claims, 2 Drawing Sheets

PROTECTIVE GLOVE HAVING INNER RIBS BETWEEN INNER LINER AND OUTER SHELL

TECHNICAL FIELD OF THE INVENTION

This invention pertains to a protective glove, such as a firefighter's glove, a welder's glove, or a fireplace glove, of a type providing thermal insulation.

BACKGROUND OF THE INVENTION

Protective gloves of the type noted above are exemplified in prior patents including U.S. Pat. No. 3,548,413, U.S. Pat. No. 4,302,851, U.S. Pat. No. 4,433,439, U.S. Pat. No. 4,454,611, U.S. Pat. No. 4,918,756, U.S. Pat. No. 5,349,705, U.S. Pat. No. 5,369,806, and U.S. Pat. No. 5,822,796. Generally, a protective glove of the type noted above comprises an inner liner, which may comprise a thermally insulative layer, a moisture-resistant layer, or both, and an outer shell, which may be made of leather or of a fabric that is abrasion-resistant, puncture-resistant, or both.

In the protective glove exemplified in U.S. Pat. No. 3,548,413, it appears that finger pieces are formed separately and are stitched to one another along their edges, which are disposed internally in the finished glove and which extend along the glove between junctions where the fingers meet and a cuff.

SUMMARY OF THE INVENTION

This invention provides improvements in a protective glove of the type noted above. Generally, a protective glove of the type noted above has a back face adapted to cover a back face of a wearer's hand, wherein the back face has a thumb-covering portion and four finger-covering portions, which include an index finger-covering portion adjacent to the thumb-covering portion, and wherein the back face has an inner liner and an outer shell. A protective glove of the type noted above may have a wristlet. Herein, the term "wristlet" is intended to cover an elasticized wristlet or a cuff, which is not elasticized.

This invention provides that the outer shell is folded so as to define inner ribs, which point toward and are able to touch the inner liner and which when touching the inner liner define pockets containing air providing thermal insulation. Preferably, if the protective glove has a back face, as described above, the outer shell of the back face is folded so as to define the inner ribs. In keeping with terminology used by persons who design protective garments, pockets containing air providing thermal insulation may be called "dead air" pockets.

Preferably, the outer shell is sewn where folded to define the inner ribs. Alternatively, the outer shell is bonded adhesively where sewn to define the inner ribs. Alternatively, the outer shell is sewn and is bonded adhesively where folded to define the inner ribs.

DETAILED DESCRIPTION OF THE ILLUSTRATED EMBODIMENTS

Figure 1:
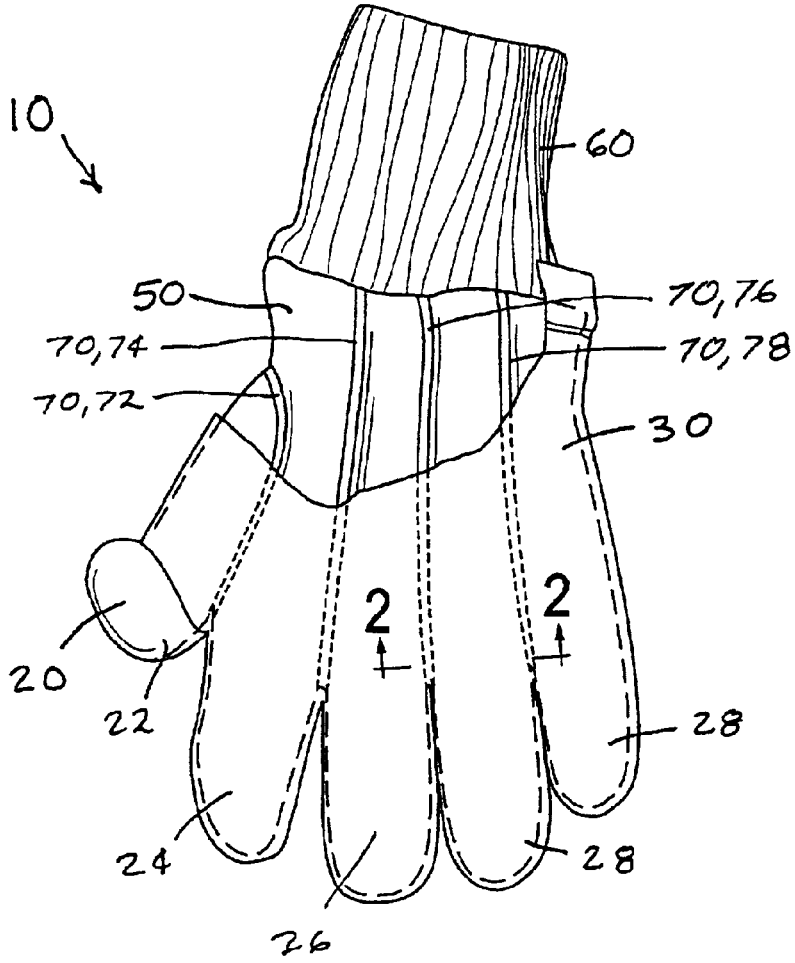
FIG. 1 is a partly broken away, plan view of a front face of one contemplated embodiment of a protective glove embodying this invention.
Figure 2:
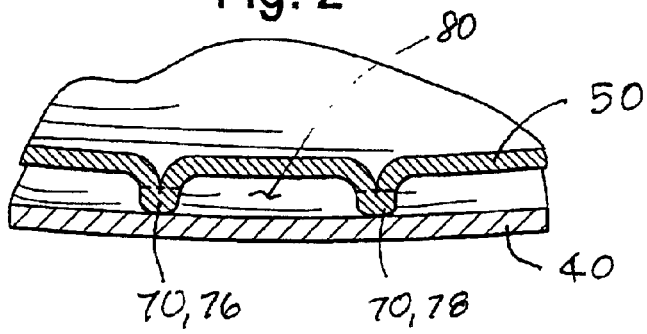
FIG. 2 is a sectional view, as taken along line 2—2 of FIG. 1, in a direction indicated by arrows.
Figure 3:
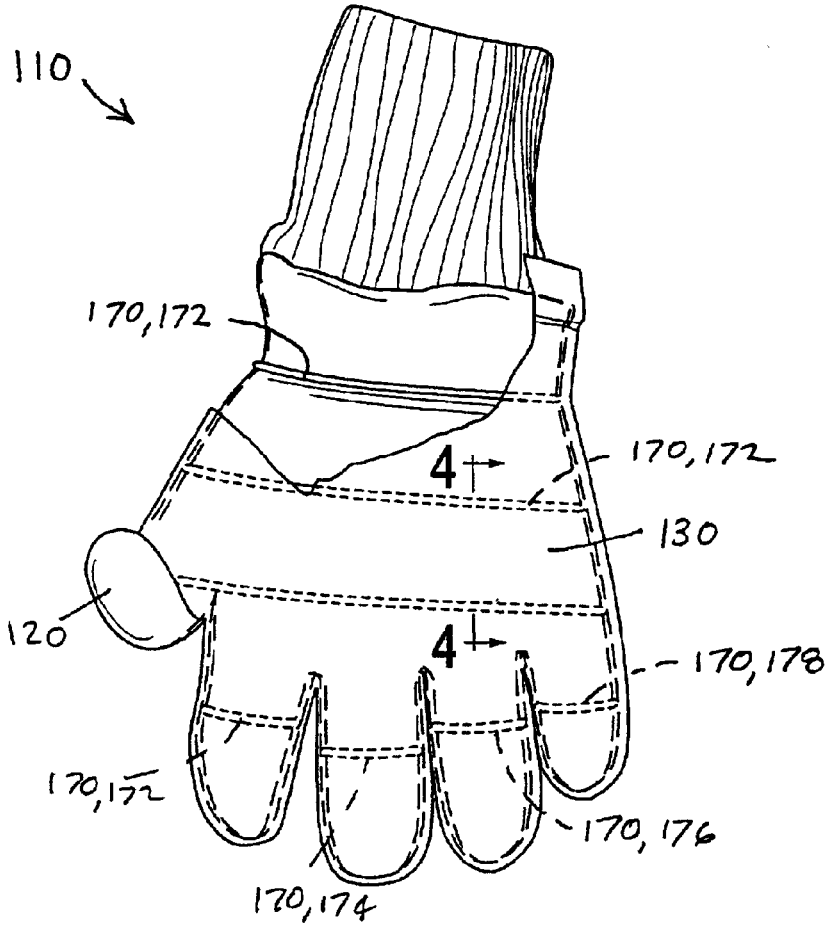
FIG. 3 is a partly broken away, plan view of an alternative embodiment of a protective glove embodying this invention.
Figure 4:
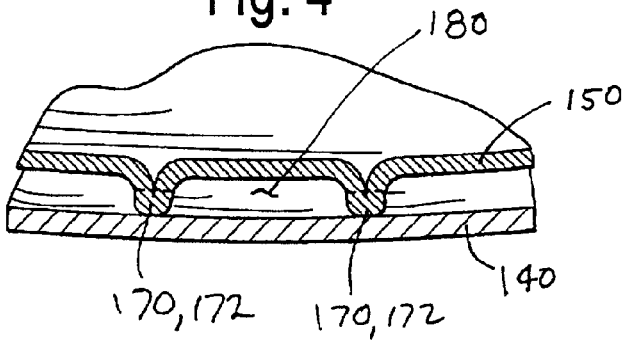
FIG. 4 is a sectional view, as taken along line 4—4 of FIG. 3, in a direction indicated by arrows.

As illustrated in FIGS. 1 and 2, a protective glove 10 embodying this invention has a back face 20, which covers the back of a wearer's hand including the wearer's thumb, index finger, and other fingers, and a front face 30. The back face 20 and the front face 30 are sewn to each other, along their edges and in a conventional manner, so as to define a thumb-covering portion 22, an index finger-covering portion 24 adjacent to the thumb-covering portion 22, a middle finger-covering portion 26, and two other finger-covering portions 28.

The back face 20 is constructed from an inner liner 40, which may comprise a thermally insulative layer, a moisture-resistant layer, or both, and an outer shell 50, which may be made of leather or of a fabric that is abrasion-resistant, puncture-resistant, or both. The front face 30 may be similarly or differently constructed. The protective glove 10 comprises a wristlet 60, which is conventional and to which the back face 20 and the front face 30 are sewn in a conventional manner.

As illustrated in FIG. 2, the outer shell 50 of the back face 20 is folded, is sewn where folded, and may be adhesively bonded where folded, so as to define inner ribs 70, which point toward and are able to touch the inner liner 40 and which when touching the inner liner 40 define pockets 80 containing air providing thermal insulation. The ribs 70 include a rib 72 terminating approximately at the wristlet 60 and approximately where the thumb-covering portion 22 and the index finger-covering portion 24 meet, a rib 74 terminating approximately at the wristlet 60 and approximately where the index finger-covering portion 24 and the middle finger-covering portion 26 meet, and two more ribs 76, 78, each of which terminates approximately at the wristlet 60 and approximately where two of the finger-covering portions meet.

As illustrated in FIGS. 1 and 2, a protective glove 110 embodying this invention is similar to the protective glove 10 and has a back face 120, constructed from an inner liner 140, and a front face 130. The outer shell 150 of the back face 120 is folded, is sewn where folded, and may be adhesively bonded adhesively where folded, so as to define inner ribs 170, which are similar to the ribs 70, except that the ribs 170 include three comparatively longer ribs 172 extending across a back face 120 of the protective glove 110 and four comparatively shorter ribs 174, each of which extends across one of the finger-covering portions of the back face 120. The ribs 170 when touching the inner liner 40 define pockets 180 containing air providing thermal insulation. Advantageously, because the ribs 170 extend across the back face 120, the ribs 170 do not tend to resist flexing of the protective glove 110, as when a wearer is grasping an item.

What is claimed is:

1. A protective glove having a thumb-covering portion and four finger-covering portions, which include an index finger-covering portion adjacent to the thumb-covering portion, the protective glove comprising an inner liner and an outer shell, wherein the outer shell is folded so as to define inner ribs, which point toward and are able to touch the inner liner and which when touching the inner liner define pockets containing air providing thermal insulation, wherein the ribs extend across the protective glove.

2. A protective glove having a back face adapted to cover a back face of a wearer's hand, the back face having a thumb-covering portion and four finger-covering portions, which include an index finger-covering portion adjacent to the thumb-covering portion, the back face having an inner liner and an outer shell, wherein the outer shell of the back face is folded so as to define inner ribs, which point toward and are able to touch the inner liner and which when touching the inner liner define air pockets containing air providing thermal insulation, wherein the ribs extend across the protective glove.

3. The protective glove of claim 1 wherein the ribs include ribs extending across the finger-covering portions.

4. The protective glove of claim 2 wherein the ribs include ribs extending across the finger-covering portions.

5. The protective glove of any one of claims 1, 2, 3, and 4 wherein the outer shell is sewn where folded so as to define the inner ribs.

6. The protective glove of any one of claims 1, 2, 3, and 4 wherein the outer shell is bonded adhesively where folded so as to define the inner ribs.

7. The protective glove of any one of claims 1, 2, 3, and 4 wherein the outer shell is sewn and is bonded adhesively where folded so as to define the inner ribs.

* * * * *